United States Patent [19]

Sato et al.

[11] Patent Number: 4,917,656

[45] Date of Patent: Apr. 17, 1990

[54] REAR BELT GUARD IN A SEWING MACHINE

[75] Inventors: Shuichi Sato, Utsunomiya; Takashi Sakai, Imaichi, both of Japan

[73] Assignee: SSMC Inc., Fairfield, N.J.

[21] Appl. No.: 380,952

[22] Filed: Jul. 17, 1989

[30] Foreign Application Priority Data

Aug. 16, 1988 [JP] Japan ..... 63-107430[U]

[51] Int. Cl.[4] ..... F16H 57/02

[52] U.S. Cl. ..... 474/144

[58] Field of Search ..... 474/144–147, 474/140; 74/608; 180/84; 280/160.1, 152 R, 159

[56] References Cited

U.S. PATENT DOCUMENTS

| | | | |
|---|---|---|---|
| 965,335 | 7/1910 | Rosenbloom et al. | 474/144 X |
| 1,213,862 | 1/1917 | Gogel | 474/146 X |
| 1,722,078 | 7/1929 | Dreyer et al. | 474/144 X |
| 2,168,501 | 8/1939 | Stoyanowski | 474/144 X |
| 2,247,381 | 7/1941 | Hohmann et al. | 474/144 X |
| 2,790,407 | 4/1957 | Andres | 474/144 X |

*Primary Examiner*—Thuy M. Bui

*Attorney, Agent, or Firm*—Theodore C. Jay

[57] ABSTRACT

A head of a sewing machine mounted on a table of the sewing machine can be turned at the rear portion thereof. A belt device is provided at the side of the head for delivering a rotary motion of a driving device to the head. A guard member is fixed to the table for covering a rear portion of a belt of the belt device which is exposed on the table. The guard member has an inclined wall upper portion provided with a notched recess for receiving the belt 7 when the head is turned rearwardly. A cover member is openable and slidable over the notched recess. The cover member is urged by a spring in a direction to be closed.

6 Claims, 6 Drawing Sheets

REAR BELT GUARD IN A SEWING MACHINE

BACKGROUND OF THE INVENTION

1. Field of the Invention

The present invention relates to a rear belt guard in a sewing machine.

2. Description of the Prior Art

A belt device for delivering a rotary motion of the driving device to a head of a sewing machine is so exposed that an operator can be placed in danger of being caught in the belt device and, in addition, the material to be sewn can also be caught and damaged. Consequently the exposed portion of the belt device should be covered by a guard. The guard must be so designed as to permit the sewing head to be turned at the rear portion thereof when the movable part of the sewing machine is covered to permit inspection of the head and the oil supply thereto.

FIG. 7 illustrates a prior art guard 100 which consists of a guard member 100*a* for covering a rear portion of a belt 103 of a belt device 102 exposed on a table 101 of a sewing machine and another guard member 100*b* for covering a front portion of the belt 103. When a head 104 of the sewing machine is turned rearward, as shown in dashed line in FIG. 7, the guard member 100*b* is independently turned rearward about a hinged portion 105 while the guard member 100*b* is swung about a fulcrum 106 on the table 101 accompanied by the movement of the head 104.

However, the prior art belt guard is subject to the undesired condition that each time the head 104 is turned, the belt 103 is loosened so that the belt 103 may separate from a driving pulley 108 fixed to a driving device 107.

There is another prior art belt guard as disclosed in Japanese Utility Model Publication No. 56-47404 and illustrated in FIG. 8.

A first cover 113 is secured to a table 110 of a sewing machine at a lower end thereof. This cover has a closed rear side having a cross section the shape of a U for covering a lower portion of the rear side of a head 112 of the sewing machine. When the head 112 is turned rearwardly, the belt 111 is secured in a holding recess 113*a* defined in the upper end rear side of the cover member 113 to prevent the belt 111 from becoming loose when the head 112 is turned.

However, in this prior art guard, an intermediate rear surface of the belt 111 is always exposed at the holding recess 113*a* during the operation of the sewing machine; this is an unsafe condition for operation of the sewing machine. In addition, foreign matter may be caught in the holding recess 113*a* and thereby hinder the operation of the sewing machine. Furthermore, when a driving pulley disposed under the table 110 is exchanged with another driving pulley having a different diameter, the dimensions of the recess 113*a* being unchanged, the belt 111 can still become loose.

SUMMARY OF THE INVENTION

The present invention is directed toward a new type of rear belt guard which overcomes the problems presented by the prior art belt guards.

It is therefore an object of the present invention to provide a rear belt guard in a sewing machine which will hold the belt in proper position in the belt device with a simple structure when the head is turned rearwardly.

It is another object of the present invention to provide a rear belt guard in a sewing machine capable of preventing the belt from being rewound on the belt device whereby the operation to return the belt device to its original position is made with ease by employment of the inexpensive belt guard.

It is still a further object of the present invention to provide a rear belt guard in a sewing machine capable of carrying out the sewing operation safely by closing the holding recess by the cover without being exposed over the table and by preventing a foreign matter from entering in the belt device.

To achieve the above objects of the present invention, the rear belt guard in a sewing machine comprises a head of a sewing machine mounted on a table 1 of the sewing machine and capable of turning in the rear portion thereof. A driving unit is disposed under the table 1. A belt device is positioned between the side of the head and the driving device and has a belt entrained around a driving pulley. This pulley is mounted on the driving unit. A driven unit mounted on the head 2 transmits a rotary motion of the driving unit to the head via the driving and driven pulleys. A belt guard covers the belt exposed over the table. This guard consists of a front belt guard for covering the front portion of the belt and a rear belt guard for covering the rear portion of the belt. The rear belt guard 9 is composed of a guard member having an inclined wall inclined downwardly toward the rear portion thereof which is provided with a notched recess at the upper surface thereof. A cover member is slidable on the notched recess and is capable of covering the notched recess 12*d*. A spring urges the cover member 19 in the direction to close the notched recess.

The above and other objects, features and advantages of the present invention will become more apparent from the following description taken in conjunction with the accompanying drawings.

DESCRIPTION OF THE PREFERRED EMBODIMENT

Figure 1:
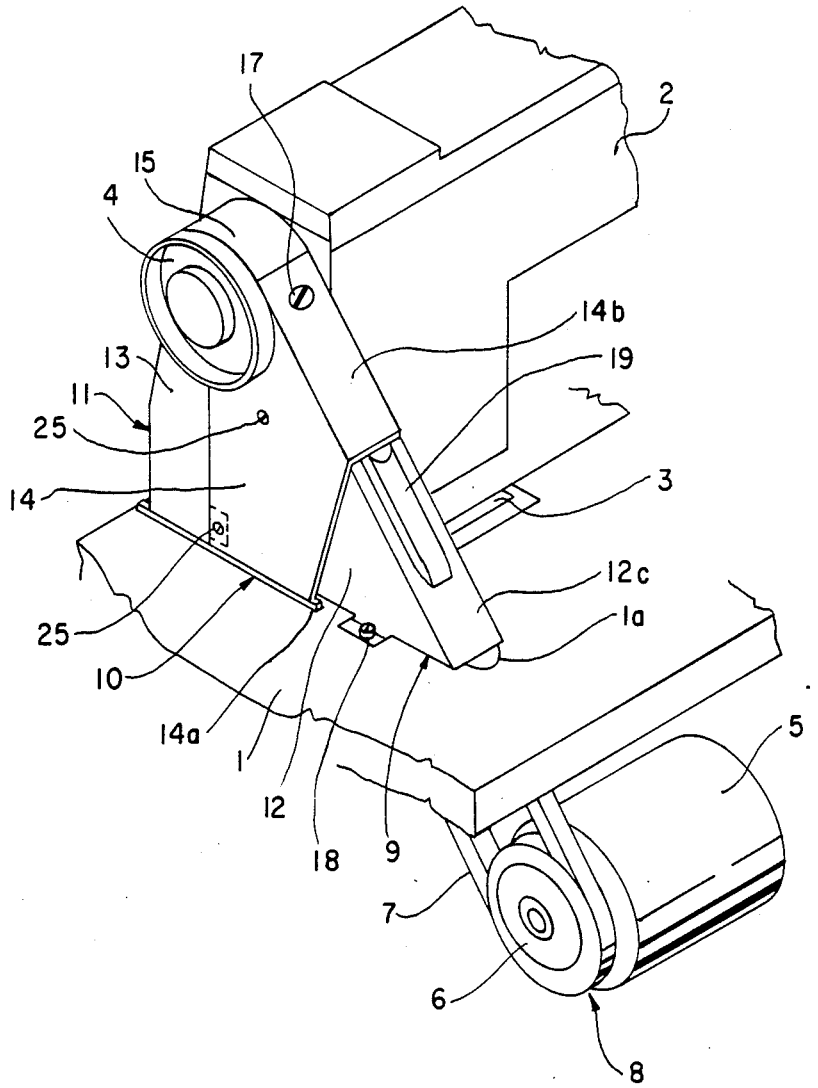
FIG. 1 is a perspective view showing a main portion of a rear belt in a sewing machine according to a preferred embodiment of the present invention.
Figure 2:
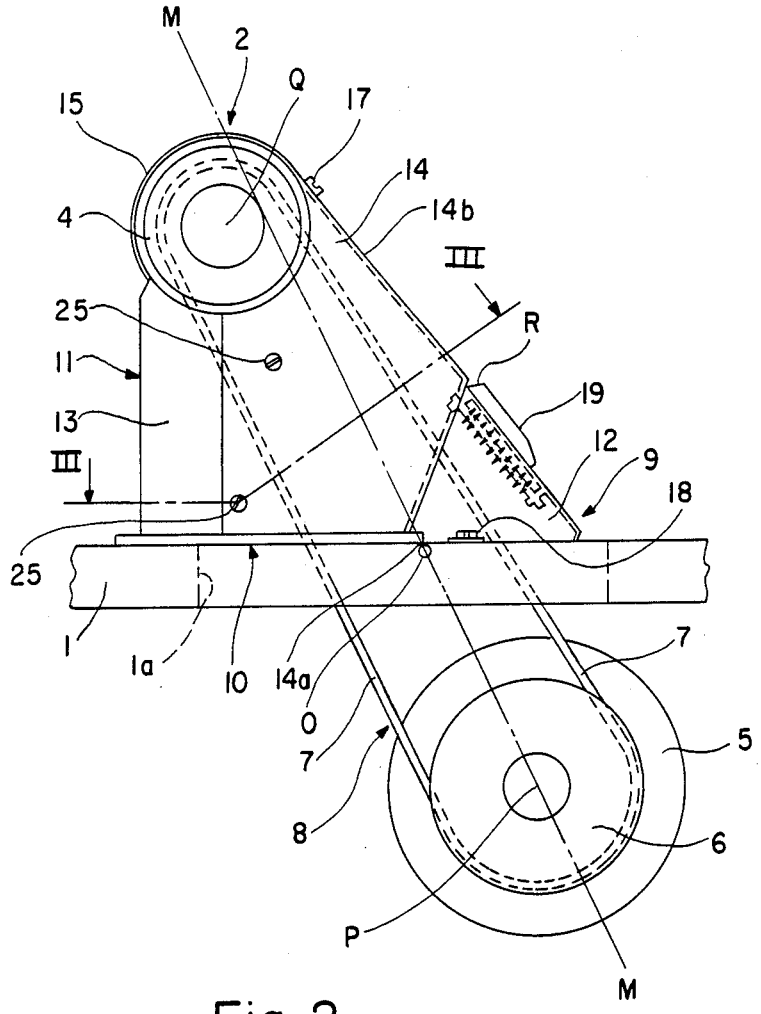
FIG. 2 is a side elevational view shown in the main portion of the rear belt of FIG. 1.

Referring now to FIGS. 1–6, a head 2 of a sewing machine is mounted on a table 1 and is capable of turning in the rear portion thereof. A driving unit 5 is disposed under the table 1. A belt device 8 is positioned between the side of the head 2 and the driving device 5. Device 8 has a belt 7 entrained around a driving pulley 6 mounted on the driving unit 5. A driven unit 4 is mounted on the head 2 for transmitting a rotary motion of the driving unit 5 to the head 2 via the driving and driven pulleys 6, 4. A belt guard 10 for covering the belt 7 exposed over the table 1 and consists of a front belt guard 7 for covering the front portion of the belt 7 and a rear belt guard 9 for covering the rear portion of the belt 7. The rear belt guard 9 is composed of a guard member 12 having an inclined wall 12*c* inclined downwardly toward the rear portion thereof which is provided with a notched recess 12*d* at the upper surface thereof. A cover member 19 is slidable on the notched recess 12*d* and is capable of covering the notched recess 12*d*. A spring 20 urges the cover member 19 in the direction to close the notched recess.

The arrangement of the rear belt guard in a sewing machine will be described in more detail.

The belt device 8 comprises a driven pulley 4 rotatably mounted on the head 2, a driving pulley 6 fixed to a motor 5 disposed under the table 1 as a driving unit, and a belt 7 entrained around the pulleys 4, 6, and turned within a belt hole defined by penetrating the table 1.

Figure 3:
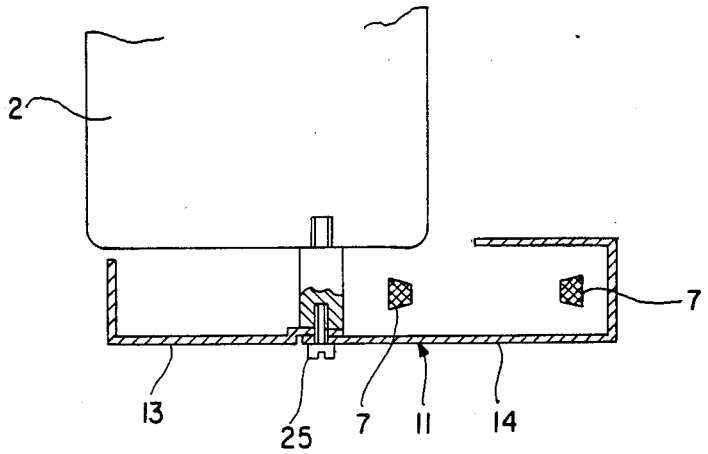
FIG. 3 is a cross sectional view taken along III—III of FIG. 2.

The belt guard 10 is secured to the table 1 for covering the belt device 8 exposed over the table 1 and is composed of a front belt guard 11 for covering a front portion of the belt 7. The front belt guard 11 is composed of first, second and third guard members 13, 14, 15. The first guard member 13 covers the uppermost front portion of the belt 7 and has an upper end which forms a circular arc having a radius substantially the same as a radius of the driven pulley 4. The first guard member 13 is positioned adjacent to the driven pulley 4 and has an L-shape in cross section as shown in FIG. 3. The second guard member 14 covers the middle portion of the belt 7 and has an upper end forming a circular arc having a radius substantially the same as a radius of the driven pulley 4. The second guard member 14 is positioned adjacent to the driven pulley 4 and has a U-shape as shown in FIG. 3. The second guard member 14 has an inclined wall 14*b* inclined downward and rearward and extending along the intermediate rear portion of the belt 7. The first guard member 13 and the second guard member 14 are partially superposed and fixed integrally to the head 2 by a screw 25 as shown in FIG. 3. The third guard member 15 having a cylindrical shape is secured to the upper end of the second guard member 14 by a screw 17 and extends to cover a substantially half circumference of the belt 7 entrained over the driven pulley 4. Thus, the assembled front belt guard 11 has a rear end edge 14*a* which is substantially coincident with a swingable center line 0 of the hinged portion 3.

Figure 4:
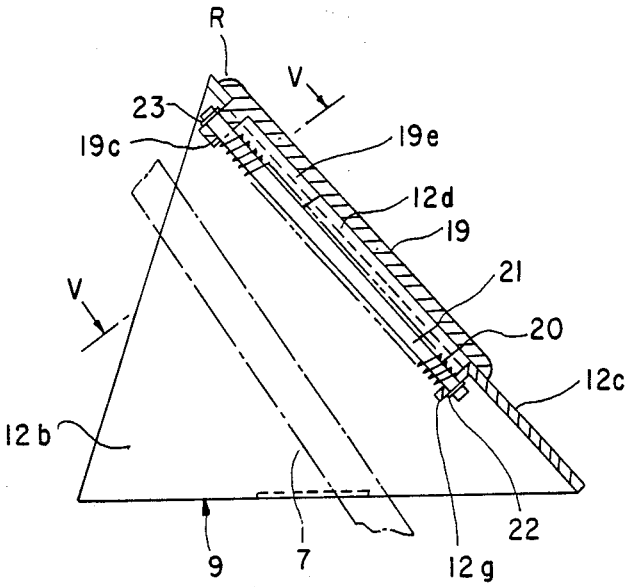
FIG. 4 is a cross sectional view showing the rear belt.
Figure 5:
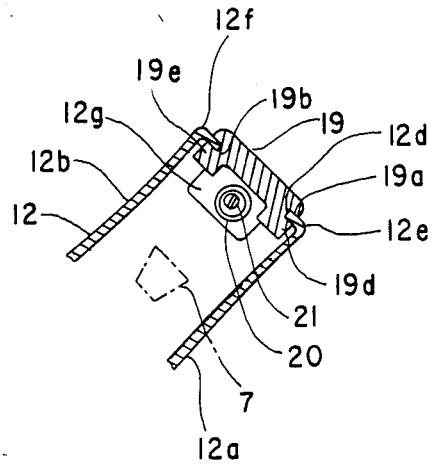
FIG. 5 is a cross sectional view taken along V—V of FIG. 4.

The guard member 12 of the rear belt guard 9 are formed, as shown in FIGS. 4 and 5, by bending a diamond shaped plate in a U-shape and is composed of a pair of side walls 12*a*, 12*b* of a triangular shape and an inclined wall 12*c*. This is formed by connecting the upper side of both side walls 12*a*, 12*b*, and is inclined downwardly rearwardly. The side walls 12*a*, 12*b*, have width greater than that of the belt 7 to receive the belt 7, but slightly less than that of the second guard member 14 of the belt guard 11 to be received by the second guard member 14 when the head 2 is rearwardly inclined while the inclined wall 12*c* is positioned across the belt hole 1*a* of the table 1 along the inclined rear portion of the belt 7 and is detechably mounted on the table 1 by a screw 18 as shown in FIG. 1. The inclined wall 12*c* has a notched recess 12*d* at the upper portion thereof which extends substantially along the inclination inclined upward and downward. A cover member 19 is provided for openably covering the notched recess 12*d* in the inclined direction of the inclined wall 12*c*. The cover member 19 is urged at all times by a spring 20 in the direction to be closed. More particularly, the cover member 19 has holding grooves 19*a*, 19*b* at the upper sides thereof and a projection 19*c* protruded from the upper edge lower surface thereof while the inclined wall 12*c* of the guard member 12 has a bent edge 12*g* formed by bending inwardly a lower edge of the notched recess 12*d*.

The cover member 19 is always urged by the spring 20 in the manner to be closed or upwardly relative to the bent edge 12*g* of the notched recess 12*d*.

As illustrated in FIGS. 4 and 5, the cover member 19 is slidably mounted on the guard member 12 in such manner that the holding grooves 19*a*, 19*b* of the cover member 19 are engaged with both side edges 12*e*, 12*f* of the notched recess 12*d*. At the same time, the spring 19 is wound compressedly on a connecting pin slidably inserted into both the projection 19*c* and the bent edge 12*g* in such manner that the cover member 19 is always urged to be closed by the spring 20, namely, urged upwardly by the spring 20. A pair of retaining rings 22, 23 mounted on the connecting pin 21 are respectively held by the projection 19*c* and the bent edge 12*g* for forming upper end stop positions so that the cover member 19 is restricted from moving further by the upper end stop positions. At this point, the notched recess 12 is substantially closed as a whole. The cover member 19 can move downwardly until both side edges 19*d*, 19*e* are brought into contact with the bent edge 12*g*.

An operation of the rear belt guard of the preferred embodiment of the present invention will be described hereinafter.

Figure 6:
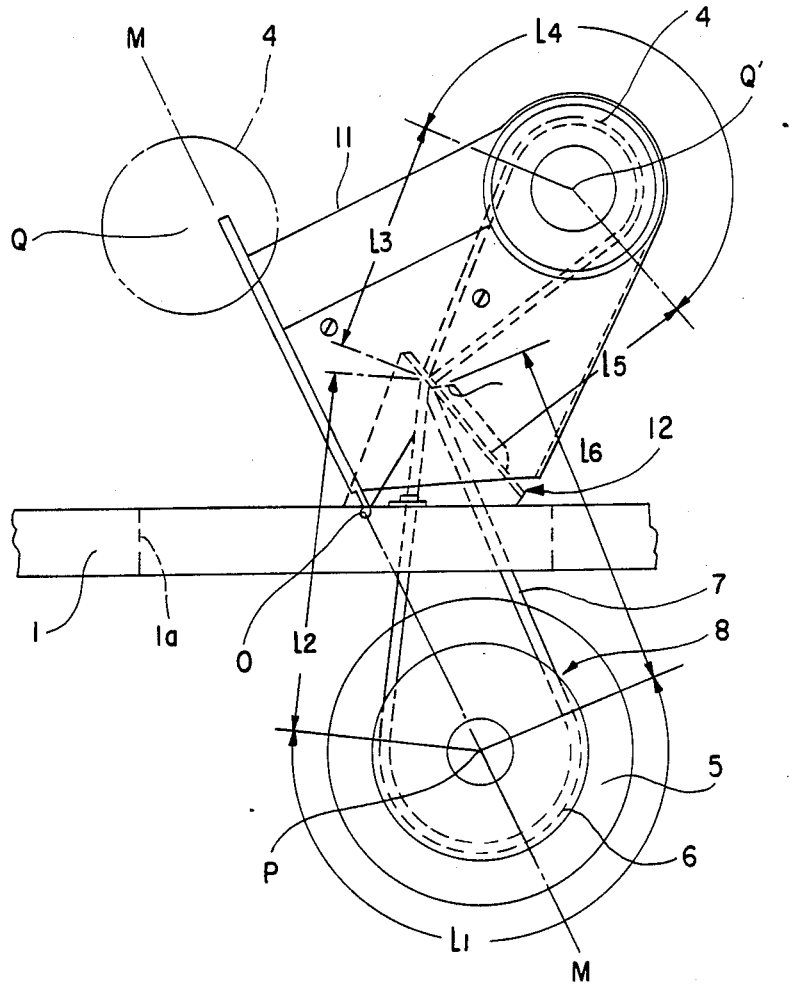
FIG. 6 is a view showing an operation of the rear belt of FIG. 1.
Figure 7:
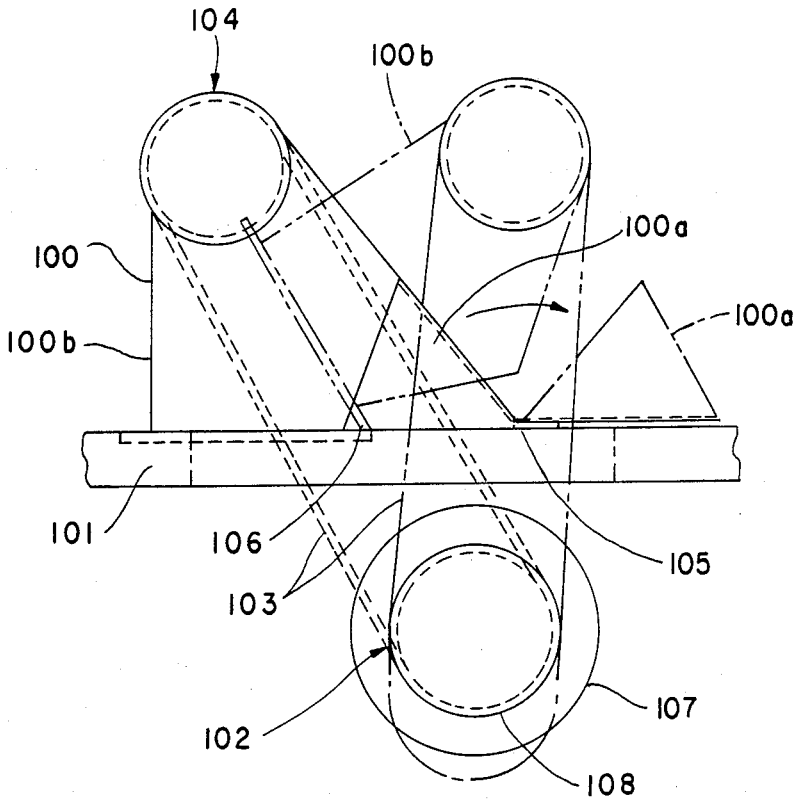
FIG. 7 illustrates one type of prior art belt guard.
Figure 8:
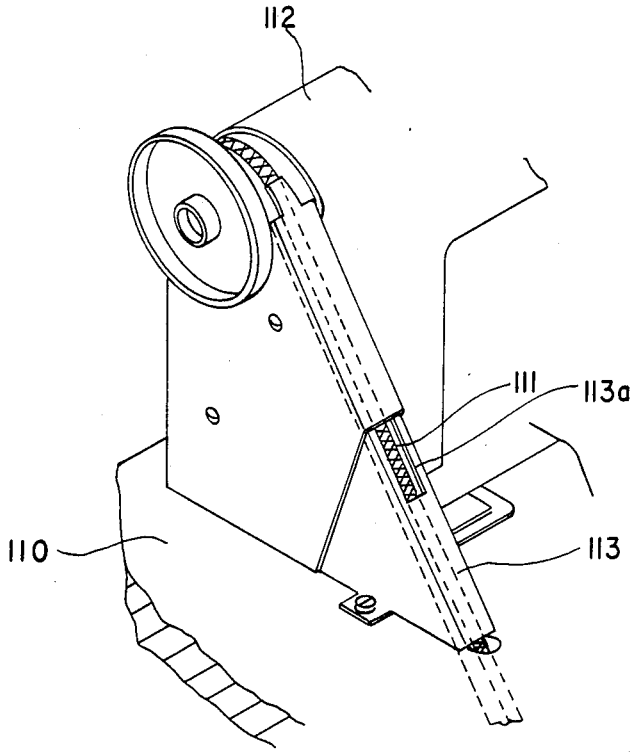
FIG. 8 illustrates another type of prior art belt guard.

When the head 2 on the table 1 is turned rearwardly about the hinged portion 3, the front belt guard 11 for covering the front portion of the belt 7 is inclined about the rear end edge 14*a* according with the swingably central line 0 of the hinged portion 3 as shown in FIG. 6. Provided that the center Q of the driven pulley 4 passes the line M—M connecting the center P of the driving pulley 6 and the center 0 of the hinged portion 3, the belt 7 starts to loosen while almost at the same time a rear side back surface of the belt 7 contacts an upper end edge R of the cover member 19 of the rear belt guard 12 covering the rear portion of the belt 7.

Meanwhile, the length of the belt 7 entrained around the driven and driving pulleys 4, 6 is determined by a center Q', a center P of the driving pulley 6 and the upper end edge R of the cover member 19. Further inclination of the head 2 makes the length of the belt 7 longer than that at the normal state when the head is not inclined so that the upper end edge R of the cover member 19 is pressed strongly by the belt 7. As a result, the cover member 19 is guided by the side edged portions 12*e*, 12*f* of the guard member 12 while the cover member 19 elastically compresses the spring 20 whereby the cover member 19 is lowered downward to open the notched recess 12*d* wherein the belt 7 is received. In this state, the bed 2 is completely inclined or turned.

The length L of the belt 7 at the time when the head 2 is inclined or turned accords at all times substantially with the entire circumferential length ($L=L1+L2+L3+L4+L5=16$). When the head 2 is kept inclined, the belt 7 is held tight thereby preventing the belt 7 from separating from the driving pulley 6.

Normally in sewing machines (especially in industrial sewing machines), the swingable center O forming the inclined center of the head 2, of the hinged portion 3, is positioned adjacent to the line connecting the center Q of the driven pulley 4 and the center P of the driving pulley P when the head 2 is not inclined. At the time when the head 2 is inclined rearwardly, if the belt 7 is not supported at the center thereof, the belt 7 is gradually loosened compared with the state where the head 2 is not inclined, namely, while the sewing machine is in operation.

In a sewing mill the driving pulley 6 is changed in order to change the sewing speed and the belt 7 fitted to pulley 6 is also changed. In this situation, if the slidable length of the cover member 19 is set to an appropriate value, it is possible to prevent the belt 7 from being loosened and separating from the driving pulley 6 where the belt 7 is inclined. When the head 2 is raised upwardly on the table 1, the cover member 19 is caused to close substantially the entire notched recess **12*d* by the elastic force of the spring 20 while the retaining rings 22, 23 are returned to their upper end stop positions in the manner to be held by the projection 19*c* and the belt edge 12*g***.

With this arrangement of the rear belt guard in a sewing machine, the following advantages can be achieved according to the present invention.

(1) It is possible to prevent the belt from being loose or separating from the belt device with a simple structure of the present invention when the head is turned rearwardly. Furthermore, it is possible to omit rewinding the belt on the belt device whereby the operation to return the belt device to its original position is made with ease by employment of the inexpensive belt guard.

(2) The sewing operation is safely carried out since the belt is not exposed over the table by closing the notched recess of the guard member by the cover. Furthermore, it prevents the entry of foreign matter into the notched recess to hinder the operation of the sewing machine.

(3) The notched recess can be opened or closed by the elastic movement of the cover member urged by the spring so that the belt is prevented from becoming loose when the pulley of the belt device is changed and the belt has a diameter different from the belt to be changed.

Although the invention has been described in its preferred form with a certain degree of particularity, it is to be understood that many variations and changes are possible in the invention without departing from the scope thereof.

What is claimed is:

1. A rear belt guard in a sewing machine comprisig:

a head of a sewing machine mounted o a table of the sewing machine and capable of turning in the rear portion thereof;

a driving unit disposed under the table;

a belt device positioned between the side of the head and the driving device and having a belt entrained around a driving pulley mounted on the driving unit and a driven unit mounted on the head for transmitting a rotary motion of the driving unit to the head via the driving and driven pulleys; and a belt guard for covering the belt exposed over the table and composed of a front belt guard for covering the front portion of the belt and a rear belt guard for covering the rear portion of the belt;

characterized in that the rear belt guard is composed of a guard member having an inclined wall inclined downwardly toward the rear portion thereof provided with a notched recess at the upper surface thereof, a cover member slidable on the notched recess and capable of covering the notched recess for receiving the belt when the head is turned, and a spring for urging the cover member in the direction to close the notched recess.

2. A rear belt guard in a sewing machine according to claim 1, wherein the guard member of the rear belt guard are formed by bending a diamond shaped plate in a U-shape and is composed of a pair of side walls of a triangular shape and an inclined wall which is formed by connecting the upper side of both side walls and inclined downwardly rearwardly.

3. A rear belt guard in a sewing machine according to claim 2, wherein the side walls have a width greater than that of the belt to receive the belt, but slightly less than that of the second guard member of the belt guard to be received by the second guard member at the time when the bed is rearwardly inclined while the inclined wall is positioned across the belt hole of the table along the inclined rear portion of the belt and detachably mounted on the table by a screw.

4. A rear belt guard in a sewing machine according to claim 2, wherein the inclined wall has a notched recess at the upper portion thereof which extends substantially along the inclination inclined upward and downward.

5. A rear belt guard in a sewing machine according to claim 1, wherein the cover member is provided for openably covering the notched recess in the inclined direction of the inclined wall, the cover member is urged at all times by a spring in the direction to be closed by the spring.

6. A rear belt guard in a sewing machine according to claim 5, wherein the cover member has holding grooves at the upper sides thereof and a projection protruded from the upper edge lower surface thereof while the inclined wall of the guard member has a bent edge formed by bending inwardly a lower edge of the notched recess.

* * * * *